US008493313B2

(12) United States Patent
Damberg et al.

(10) Patent No.: US 8,493,313 B2
(45) Date of Patent: Jul. 23, 2013

(54) TEMPORAL FILTERING OF VIDEO SIGNALS

(75) Inventors: Gerwin Damberg, Vancouver (CA); Helge Seetzen, Vancouver (CA)

(73) Assignee: Dolby Laboratories Licensing Corporation, San Francisco, CA (US)

( * ) Notice: Subject to any disclaimer, the term of this patent is extended or adjusted under 35 U.S.C. 154(b) by 1253 days.

(21) Appl. No.: 12/030,448

(22) Filed: Feb. 13, 2008

(65) Prior Publication Data

US 2009/0201320 A1 Aug. 13, 2009

(51) Int. Cl.
*G09G 3/36* (2006.01)

(52) U.S. Cl.
USPC ..... 345/102; 345/691; 345/694

(58) Field of Classification Search
USPC ..... 345/102, 589, 694, 691; 348/844
See application file for complete search history.

(56) References Cited

U.S. PATENT DOCUMENTS

| | | | | |
|---|---|---|---|---|
| 6,178,205 | B1 * | 1/2001 | Cheung et al. | 375/240.29 |
| 6,285,798 | B1 * | 9/2001 | Lee | 382/260 |
| 7,419,267 | B2 * | 9/2008 | Whitehead et al. | 353/30 |
| 7,817,131 | B2 * | 10/2010 | Seetzen | 345/102 |
| 7,872,631 | B2 * | 1/2011 | Feng et al. | 345/102 |
| 7,872,659 | B2 * | 1/2011 | Seetzen | 345/690 |
| 7,898,519 | B2 * | 3/2011 | Feng | 345/102 |
| 8,035,607 | B2 * | 10/2011 | Otome | 345/102 |
| 2001/0035853 | A1 * | 11/2001 | Hoelen et al. | 345/102 |
| 2002/0190940 | A1 * | 12/2002 | Itoh et al. | 345/87 |
| 2003/0161407 | A1 | 8/2003 | Murdock et al. | |
| 2003/0201968 | A1 * | 10/2003 | Itoh et al. | 345/102 |
| 2005/0184952 | A1 | 8/2005 | Konno | |
| 2005/0237293 | A1 * | 10/2005 | Kim et al. | 345/102 |
| 2006/0045181 | A1 * | 3/2006 | Chen | 375/240.12 |
| 2006/0103621 | A1 * | 5/2006 | Feng | 345/102 |
| 2006/0152469 | A1 * | 7/2006 | Hsu | 345/102 |
| 2006/0239033 | A1 * | 10/2006 | Jung et al. | 362/612 |
| 2007/0035706 | A1 | 2/2007 | Margulis | |
| 2007/0216636 | A1 * | 9/2007 | Lo | 345/102 |
| 2007/0216819 | A1 * | 9/2007 | Seetzen | 348/844 |
| 2007/0222740 | A1 * | 9/2007 | Hanada | 345/102 |
| 2007/0279372 | A1 * | 12/2007 | Brown Elliott et al. | 345/102 |
| 2007/0279373 | A1 * | 12/2007 | Tseng et al. | 345/102 |
| 2007/0285379 | A1 | 12/2007 | Jung et al. | |

(Continued)

FOREIGN PATENT DOCUMENTS

| | | |
|---|---|---|
| CN | 1120780 | 4/1996 |
| CN | 1637508 | 7/2005 |

(Continued)

OTHER PUBLICATIONS

International Search Report mailed Feb. 6, 2009.

*Primary Examiner* — Amare Mengistu
*Assistant Examiner* — Sarvesh J Nadkarni

(57) ABSTRACT

A process for reducing noise and temporal artifacts (e.g. walking LEDs) on a dual modulation display system by applying temporal filtering to rear modulation signals of a sequence of video frames. Flare and dimming rates are calculated for a current frame in the video. If a flare rate threshold is exceeded, an intensity of the backlight is limited to a predetermined flare rate. If a dimming rate threshold is exceeded, the backlight intensity is limited to a predetermined dimming rate. The limitations are applied, for example, on an element-by-element basis. In the event of a scene change, the limitations do not need to be applied. A forward modulation signal is calculated by taking into account any applied backlight limitations.

24 Claims, 5 Drawing Sheets

U.S. PATENT DOCUMENTS

| | | | | |
|---|---|---|---|---|
| 2007/0285382 | A1* | 12/2007 | Feng | 345/102 |
| 2007/0285587 | A1* | 12/2007 | Seetzen | 348/844 |
| 2008/0007512 | A1* | 1/2008 | Honbo | 345/102 |
| 2008/0068328 | A1* | 3/2008 | Jou et al. | 345/102 |
| 2008/0129677 | A1* | 6/2008 | Li et al. | 345/102 |
| 2008/0150881 | A1* | 6/2008 | Chen et al. | 345/102 |
| 2008/0158245 | A1* | 7/2008 | Lieb et al. | 345/596 |
| 2008/0180465 | A1* | 7/2008 | Whitehead et al. | 345/694 |
| 2008/0180466 | A1* | 7/2008 | Whitehead et al. | 345/698 |
| 2008/0218467 | A1* | 9/2008 | Huang | 345/102 |
| 2008/0266240 | A1* | 10/2008 | Chen et al. | 345/102 |
| 2009/0079754 | A1* | 3/2009 | Chen et al. | 345/589 |
| 2009/0167672 | A1* | 7/2009 | Kerofsky | 345/102 |
| 2009/0167751 | A1* | 7/2009 | Kerofsky | 345/214 |
| 2010/0053222 | A1* | 3/2010 | Kerofsky | 345/690 |

FOREIGN PATENT DOCUMENTS

| | | | |
|---|---|---|---|
| CN | 101038731 | | 9/2007 |
| CN | 101099191 | | 1/2008 |
| EP | 0853436 | | 7/1998 |
| JP | 2001-142409 | | 5/2001 |
| JP | 2005-258403 | | 9/2005 |
| JP | 2007-272023 | | 10/2007 |
| KR | 10-2006-0124132 | | 12/2006 |
| KR | 10-2007-0028158 | | 3/2007 |
| KR | 10-2007-0117847 | | 12/2007 |
| RU | 2310289 | | 11/2007 |
| WO | 2005093703 | A | 10/2005 |
| WO | 2005107237 | A | 11/2005 |

* cited by examiner

FIG. 3A
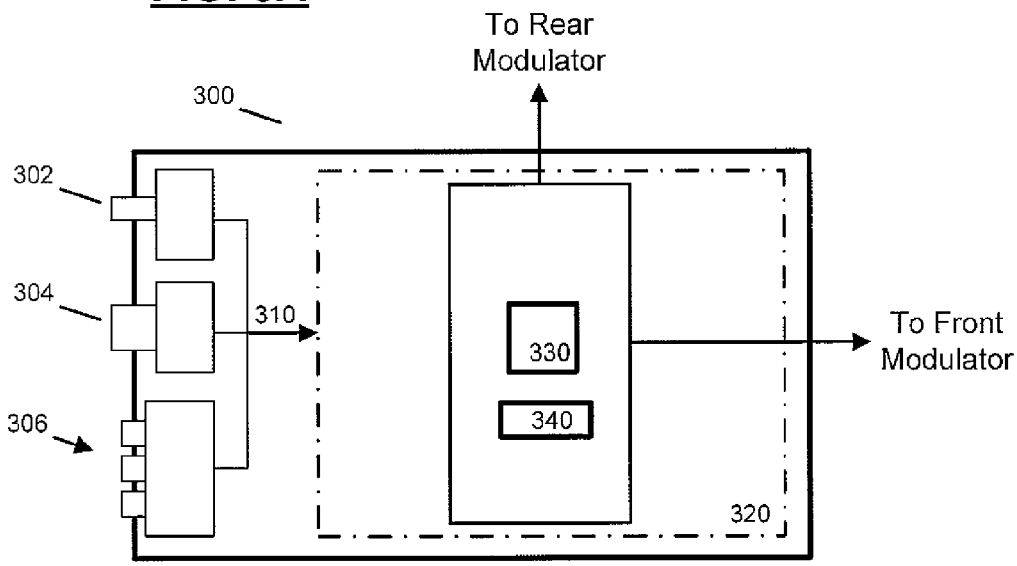
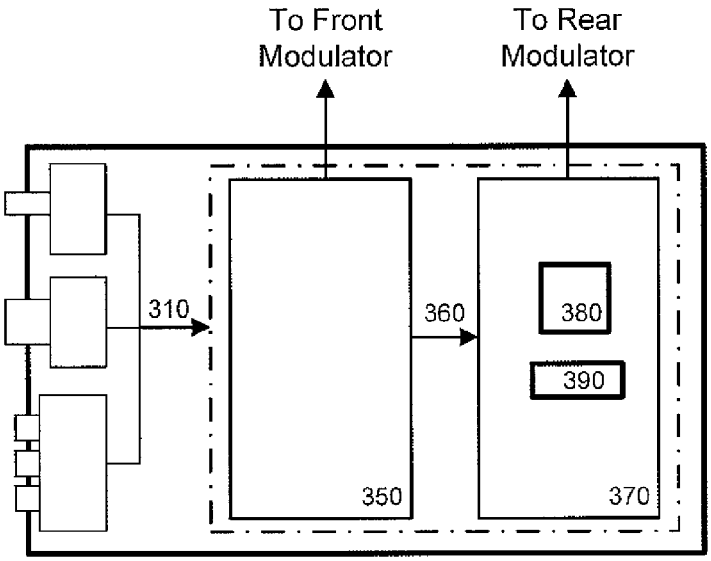
FIG. 3B

Checkerboard

Backlight Drive Signal Results

TEMPORAL FILTERING OF VIDEO SIGNALS

COPYRIGHT NOTICE

A portion of the disclosure of this patent document contains material which is subject to copyright protection. The copyright owner has no objection to the facsimile reproduction by anyone of the patent document or the patent disclosure, as it appears in the Patent and Trademark Office patent file or records, but otherwise reserves all copyright rights whatsoever.

BACKGROUND OF THE INVENTION

1. Field of Invention

The present invention relates to display devices, and more particularly to dual modulation display devices and processes and structures for reducing artifacts in images displayed on such devices.

2. Discussion of Background

Dynamic range is the ratio of intensity of the highest luminance parts of a scene and the lowest luminance parts of a scene. For example, the image projected by a video projection system may have a maximum dynamic range of 300:1.

The human visual system is capable of recognizing features in scenes which have very high dynamic ranges. For example, a person can look into the shadows of an unlit garage on a brightly sunlit day and see details of objects in the shadows even though the luminance in adjacent sunlit areas may be thousands of times greater than the luminance in the shadow parts of the scene. To create a realistic rendering of such a scene can require a display having a dynamic range in excess of 1000:1. The term "high dynamic range" means dynamic ranges of 800:1 or more.

Modern digital imaging systems are capable of capturing and recording digital representations of scenes in which the dynamic range of the scene is preserved. Computer imaging systems are capable of synthesizing images having high dynamic ranges. Recently, display systems have begun to utilize dual modulation systems for rendering images in a manner which more faithfully reproduces high dynamic ranges.

SUMMARY OF THE INVENTION

The present inventors have realized the need to reduce artifacts that occur in high dynamic range display systems and particularly artifacts that result from dual modulation systems incorporating modulators of different resolutions. In one embodiment, the present invention provides a method including steps of receiving a current frame of a video, calculating a rear modulation signal of the current frame, calculating a difference in intensity between the rear modulation signal of the current frame and a rear modulation signal of a previous frame, and modifying the rear modulation signal of the current frame with a filtering limit R to obtain an actual rear modulation signal of the current frame. The filtering limit is, for example, performance characteristics of a display on which the video is to be displayed and/or characteristics of the video signal. In one embodiment, the rear modulation signal is not modified if a scene change in the video signal is detected.

In another embodiment, the present invention is a high dynamic range display, comprising a front modulator unit, a rear modulation unit comprising an array of individually controllable backlights having a resolution lower than a resolution of the front modulation unit and configured to project modulated light onto the front modulation unit, and a controller coupled to the rear modulation unit and configured to prepare a rear modulation signal and transmit it to the rear modulation unit, said rear modulation signal limited according to at least one of a flare rate and a dimming rate. In one embodiment, the controller is further configured to determine a scene change in a video to be displayed and prepare the rear modulation signal without limitations during the scene change.

In yet another embodiment, the invention is a controller configured to provide control signals to each individually controllable light element of a light element array, said control signals comprising an amount of light derived from a video signal and limited in intensity if at least one of a flare rate threshold and a dimming rate threshold are exceeded. In one embodiment, the limitation of intensity is performed in an area-by-area basis of a video image such that one area of the video image may be limited in intensity and another area is not limited, and at least one of the thresholds is determined dynamically.

Portions of any device or method embodying the invention may be conveniently implemented in programming on a general purpose computer, or networked computers, and the results may be displayed on an output device connected to any of the general purpose, networked computers, or transmitted to a remote device for output or display. In addition, any components of the present invention represented in a computer program, data sequences, and/or control signals may be embodied as an electronic signal broadcast (or transmitted) at any frequency in any medium including, but not limited to, wireless broadcasts, and transmissions over copper wire(s), fiber optic cable(s), and co-ax cable(s), etc.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein:

FIG. 3A is a block diagram of electronic and/or computer components arranged to implement processes according to an embodiment of the present invention;

FIG. 3B is a block diagram of electronic and/or computer components arranged to implement processes according to an embodiment of the present invention;

DESCRIPTION OF THE PREFERRED EMBODIMENTS

The invention relates to a method for processing image data to be displayed on a dual modulation display system, and more particularly to a method for reducing (temporal) noise and image artifacts by applying temporal filtering to rear modulation signals of a sequence of video frames.

Figure 1:
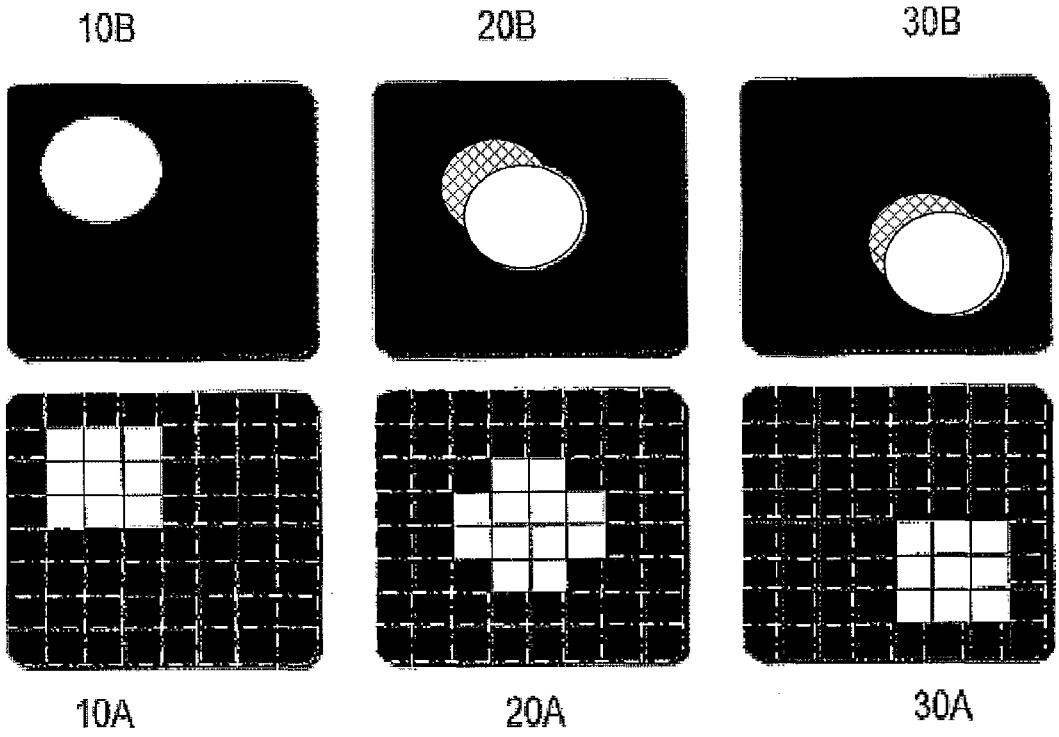
FIG. 1 is an illustration of a backlighting paradigm that illustrates Backlight Motion Aliasing and the cause of the "Walking" LED problem.

Employing a low-resolution modulated backlight to illuminate an LCD panel introduces unwanted image artifacts to the display. For example, due to the inability of an LCD to completely block light, the backlight illuminating a bright feature surrounded by a dark area results in a dim halo around the feature, with the edge contrast being limited to the contrast of the panel. If the halo is not symmetric about the feature, the effect may become more noticeable and halo artifacts are exacerbated as an object moves, as the halo changes shape and does not follow the exact motion of the object, due to the low resolution of the backlight. The halo can be perceived to stick on the background as the object moves, dragging behind, then suddenly jumping ahead of the object to catch up before starting to drag behind again. The stuttering motion of the halo along with its changing shape can resemble the action of taking steps, or "walking." FIG. 1 which shows the progression of a shape (shots 10B, 20B, and 30B) superimposed over backlights 10A, 20A, and 30A, respectively, and a halo (see shots 20B and 30B). This image artifact can be especially noticeable if the power of the backlight is not preserved for the moving feature, as it will tend to pulse and dim as well. The root cause of the walking effect can be traced to spatial aliasing in the backlight signal.

Some contemporary technologies (e.g. Dolby Contrast™ display) use the concept of veiling luminance to hide halo artifacts. The light that leaks through a black LCD pixel is designed to be lower than the perceptual limitations caused by veiling luminance so that the contrast limitations of the display are not observed. The veiling luminance method alone, however, does not fully resolve the walking LEDs problem, as the root cause of this artifact is in connection with spatial aliasing in the backlight signal. Therefore, to minimize this noticeable effect, backlight drive levels need to be computed in a band-limited manner (e.g., preventing or reducing the transmission of higher spatial frequencies from neighboring backlights), which is stable with respect to small changes in the feature position, orientation, and intensity, in a single frame as well as over time. Approaches to determine the rear-modulation signal employing down-sampling methods and spatial smoothing/filtering may be used (for example, Dolby Contrast™ licensed displays) to minimize the noticeable effects of the difference in resolution between the backlight and the LCD.

The present invention discloses a method for reducing noise and temporal artifacts (e.g. walking LEDS) by applying temporal filtering to rear modulation signals of a sequence of video frames to be displayed on a dual modulation display system. In a dual modulation display system that uses individually modulated light sources as a backlight to illuminate an LCD panel, filtering limits (e.g. flare rate $R_{flare}$ and dimming rate $R_{dim}$), are determined and are used to control the maximum change in intensity of any individual backlight element (or cluster of backlight elements) between consecutive video frames to smooth the backlight gradient over time. The temporal limits are preferably ignored when a scene change frame is detected. Scene changes are detected, for example, by comparing the difference in overall luminance intensity of consecutive video frames with an adjustable threshold T. Alternatively, metadata in the video stream may also be available to specifically point to scene changes. It is known that there are a variety of methods to detect a scene change. Most of the work has been done in video compression and video processing. Regardless of the method used, a scene change, or any other set of frames where the overall change in the output image significantly reduces or eliminates the need for dampening effects, the dampening processes of the present invention may be bypassed.

In general, the process of scene change detection and the application of dampening where appropriate is applied globally, or across an entire backlight. However, the same type of processes may be applied locally to portions of scenes that may also change over time. Scene change algorithms applied to portions of scenes may be based on scene portion comparisons across frames, heuristics of a frame or local area, and possibly metadata in the video stream.

It is also notable that, based on the number of backlight elements the computational costs of temporal dampening increase or decrease. A smaller display, or a larger display with less backlights (e.g., 200 backlight elements—such as LEDs or LED clusters) can require significantly less computational power than similarly sized displays with many (e.g. 1400 or more) backlight elements. However, the need for temporal dampening is increased with the smaller number of backlights because the aliasing effects and other problems associated with reduced resolution backlights can be accentuated in displays with comparatively lower backlight resolutions (creating a trade-off because this depends largely of the spatial distribution of light through the optics (e.g. a very wide point spread function (PSF) could mitigate the artifact(s), a very narrow PSF would allow maximizing local contrast)).

An exemplary temporal dampening approach according to the invention comprises the steps of:

(1) Receiving a current frame. The frame is, for example, a frame to be displayed from a video data stream. The video data stream originates, for example, from a camera, a recorded media source (DVD, HD-DVD™, Blu-ray™, etc), a digital or other broadcast (e.g., terrestrial, satellite, wireless network, etc).

(2) Calculating a rear modulation signal of the current frame. The rear modulation signal comprises, for example, data for setting intensity levels of individual lights (or light clusters) in a backlight of a display.

(3) Modifying the rear modulation signal of the current frame with an average (e.g., weighted average) of the modulation signals of the current frame and the modulation signal of the previous frame or frames.

The above modifying step, step (3), uses an average that can be embodied in different forms. The average as stated is the average between two frames (current and previous frames). Alternatively, a weighted average across n previous frames and the current frame (n+1) may be utilized.

In another embodiment, the present invention may be embodied as a method comprising the steps of:

(1) Receiving a current framer;

(2) Calculating a rear modulation signal of the current frame;

(3) Calculating a difference in intensity between the rear modulation signal of the current frame and the rear modulation signal of the previous frame. The difference in intensity is calculated, for example, by subtracting each backlight element's intensity in the current frame from the intensity of the same backlight element in the previous frame. The intensity levels can be computed, for example, based on the modulation signals themselves, or an energization level of the backlight element contained in the modulation signal, etc. (such computations may include, for example, variables for individual differences in backlight elements whether such differences are by design or variances in manufacturing quality, etc).

(4a) If the difference in intensity between the rear modulation signal of the current frame and the rear modulation signal of the previous frame exceeds a predefined or dynamically computed intensity difference criteria (e.g. a threshold or a rate), then modifying the rear modulation signal of the current frame with a pre-determined filtering limit R to obtain the actual rear modulation signal for the current frame.

(4b) If the difference in intensity between the rear modulation signal of the current frame and the rear modulation signal of the previous frame does not exceed the predefined threshold, then utilizing the rear modulation signal calculated in step (2) as the actual desired rear modulation signal for the current frame.

Steps (3), (4a), and (4b) can be performed across the entire backlight, or the backlight may be divided into areas with steps (3), (4a), and (4b) applied on each area for each frame. The number of areas which the steps are applied may be dynamic. Scenes may be divided into two areas, some scenes may be efficiently divided into several areas, while other scenes are more efficient, or produce effective results when left as a single area. Further, the criteria (e.g. threshold and/or rate) itself can be dynamic (e.g. based on intensity or desired change of rear modulation signal).

Figure 2:
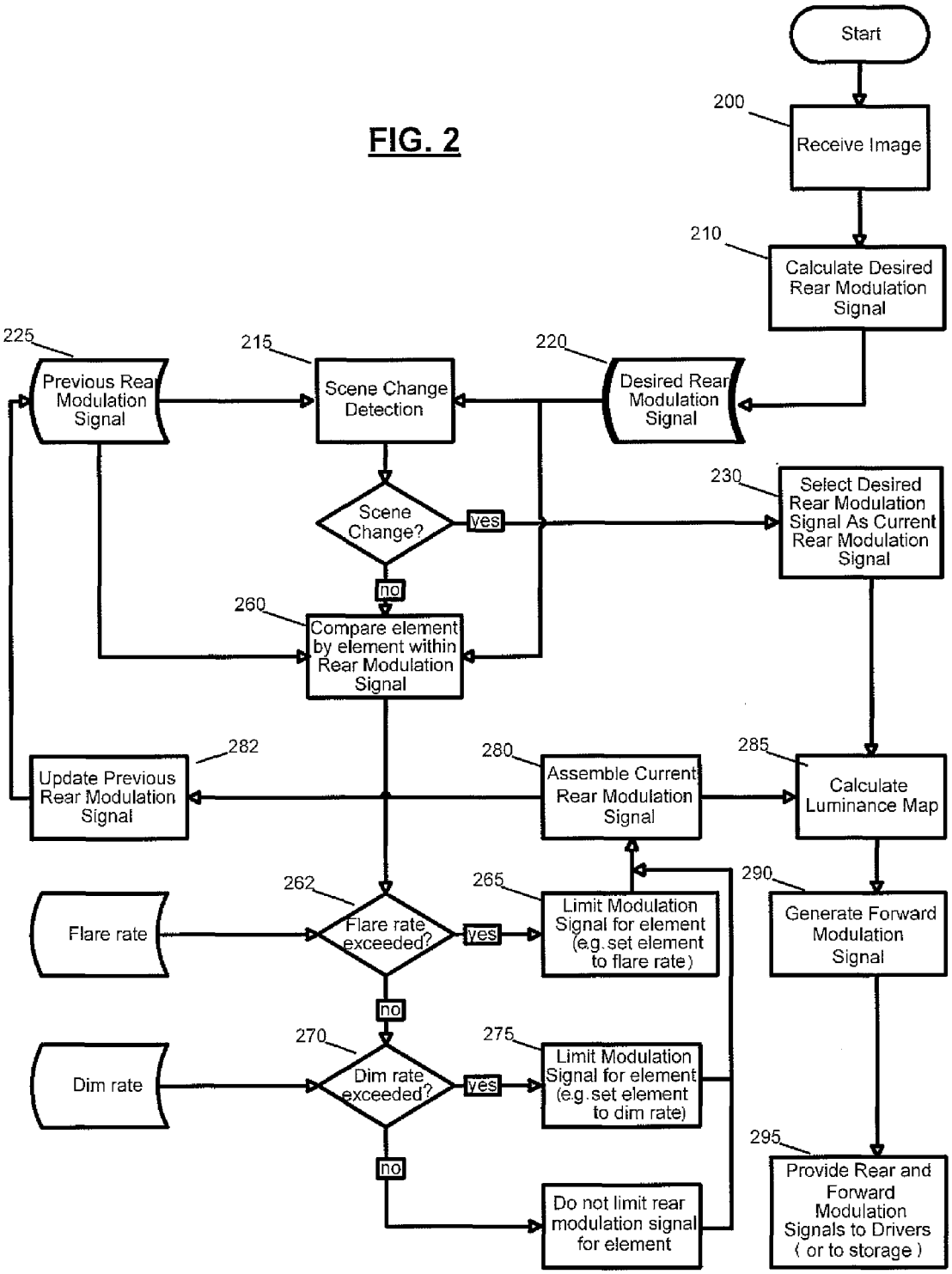
FIG. 2 is a flow chart of a process according to an embodiment of the present invention.

Another exemplary temporal dampening approach is described in FIG. 2. At step 200, an image is received. The image is, for example, a frame in a video received from a broadcast or from pre-recorded material. A desired rear modulation signal 220 for the frame is then calculated (e.g., calculated in step 210).

At step 215, a scene change detection is performed. The scene change detection is performed, for example, by comparing the desired rear modulation signal 220 to a previous rear modulation signal (e.g., signal 225). The comparison may alternatively include an integration across multiple previous frames or modulation signals, and those previous frames or signals may be weighted so that, for example, more recent frames have greater influence in the comparison. If a scene change is detected, the desired rear modulation signal is utilized for the current frame (step 230).

If a scene change is not detected, a comparison of the desired rear modulation signal and the previous rear modulation signal is performed. The comparison is, for example, an element-by-element comparison of the backlight elements from the previous frame (e.g., contained in the previous rear modulation signal) vs. the current frame (as contained in the calculated desired rear modulation signal), illustrated at step 260. The comparison is then used to determine if either a predetermined flare rate (step 262) or a predetermined dimming rate (step 270) are exceeded.

The flare rate and the dimming rate are set, for example, based on the characteristics of the display which the dampening process is implemented. The rates may be determined empirically from either the display's specification, by experimental observation, or by a combination of both. As an example, a display with a 60 Hz refresh rate may carry a flare rate of 10 percent. Generally speaking, a similar display having a refresh rate of 120 Hz would carry a flare rate of 5 percent.

In other example embodiments, lower rates are utilized. For example, a 5% rate on a 30 Hz display and indicative of an implementation that takes 20 frames (approx. ⅔ of a second) to go from a full black to a full white signal. Other factors that influence the determination of the criteria (rate/threshold) are the number of elements and dimensions, the optical spatial characteristics (PSF), the limitations and capabilities of the viewer (e.g., Human Visual System (HVS)), and the luminance range of the display. Further, as noted above, the rate could be determined dynamically based on all or some of these factors and the content.

If the flare rate is exceeded, the desired rear modulation signal for elements exceeding the flare rate are then limited in flare (e.g., see step 265). For example, on a 60 Hz display having a 2% flare rate, if a series of backlight elements have flared greater than 2% (e.g., in the 10-20% range), the rear modulation signal is modified such that those elements flare is limited. In one embodiment, the amount of limitation is equivalent to the flare rate, or 9% in this example.

If the dimming rate is exceeded, the desired rear modulation signal for elements exceeding the dimming rate are then limited in dimness (e.g., see step 275). For example, on a display having a 4% dimming rate, if a series of backlight elements have dimmed greater than 4%, the rear modulation signal is modified such that those elements dimness is limited. In one embodiment, the amount of limitation is equivalent to the dimming rate, or 4% in this example.

If neither the dimming rate nor the flare rate is exceeded, limitations may or may not be applied to the rear modulation signal. The limitations from either the flare or dimming rate calculations are combined, or assembled, to produce the current rear modulation signal (step 280) (the assembly comprises, for example, modifying the desired rear modulation signal with any flare or dimming rate limitations). The current modulation signal is used in step 282 to update the previous rear modulation signal 225—which is then used in calculations related to the next frame or image to be displayed.

At step 285, a luminance map is calculated. The luminance map is constructed from either the current modulation signal (in the case where flare or dimming rate limitations were applied) or the desired rear modulation signal (in the cases where either a scene change is detected or the flare and dimming rates were not exceeded).

At step 290 a forward modulation signal is generated. The forward modulation signal can be the same signal that would be generated without dampening, or preferably the signal is based in part on the assembled rear modulation signal. By taking into account the dampened backlight signal, the LCD values can be further adjusted to produce an image that is more artifact free.

In one embodiment, the invention comprises the steps of:

(1) Receiving a current frame;

(2) Calculating a desired rear modulation signal of the current frame;

(3) Determining (adjusting or reading from storage) a scene change criteria (e.g. threshold T) (either a comparison as described above or any other scene detection process may be utilized);

(4) Calculating the difference in intensity between the desired rear modulation signal of the current frame and the rear modulation signal of the previous frame;

(5) Determining whether the intensity difference calculated in Step (4) exceeds the threshold T. If yes, selecting desired rear modulation signal of the current frame as an actual rear modulation signal of the current frame, then go to Step (10); otherwise, continue onto Step (6);

(6) Determining (adjusting) a flare rate $R_{flare}$ and a dimming rate $R_{dim}$ (the scene detection and all parameters used with it can be de-coupled from the flare and dimming rates);

(7) At the individual backlight element level, computing the difference in intensity between the desired rear modulation signal of the current frame and the rear modulation signal of the previous frame on an element by element basis;

(8) For elements with the intensity difference calculated in Step (7) exceeding the flaring rate $R_{flare}$, modifying their corresponding rear modulation signals of the current frame using $R_{flare}$; for elements with the intensity difference calculated in Step (7) exceeding the dimming rate $R_{dim}$, modifying their corresponding rear modulation signals of the current frame using $R_{dim}$; and for elements with the intensity difference calculated in Step (7) exceeding neither the flaring rate $R_{flare}$ nor the dimming rate $R_{dim}$, leaving their corresponding rear modulation signals of the current frame unmodified;

(9) Assembling the rear modulation signals of the current frame for all elements (cluster), both modified and unmodified, into an actual rear modulation signal of the current frame.

(10) Updating the rear modulation signal of the previous frame with the actual rear modulation signal of the current frame.

Although the $R_{flare}$ and $R_{dim}$ rates are fixed, for example, based on empirical results or experimental observation, the above algorithms may be modified to substitute dynamic flare and dim values. For example, a display may have variable performance specifications under certain conditions (e.g., a display may perform differently when the changes in modulation occur in a mostly dark scene compared to a mostly bright scene. To match those conditions, $R_{flare}$ or $R_{dim}$ may be adjusted to match the varying performance of the display. Such adjustments could be implemented via a formula or by lookup in a table. Alternative or yet further adjustments may be made such that the damping also matches the performance characteristics of the human visual system (HVS) which itself adjusts more quickly in dark to light scene progressions compared to light to dark scene progressions. Therefore, in a scene transitioning from light to dark, $R_{flare}$ and $R_{dim}$ may take on values that more closely match the performance of the human eye under light to dark viewing conditions. Determining whether a scene transitions under conditions that make an adjustment in $R_{flare}$ and/or $R_{dim}$ can be done by comparison of the current frame to one or more previous frames (potentially also upcoming frames or information about upcoming frames (meta data). When determining rates and flaring and dimming rates (dynamic or static) that are different from each other, the total light energy on the backlight can continuously increase or decrease potentially leading to artifacts. Potential benefit may therefore accrue by "balancing" the rates.

FIG. 3A is a block diagram of electronic and/or computer components arranged to implement processes according to an embodiment of the present invention. Video inputs, for example cable/antenna 302, HDMI 304, and component inputs 306 provide hardware connections to external devices that, along with other electronics not described, ultimately provide a video signal 310 to a control board 320. The control board 320 may comprise any combination of electronics and/or computer (micro) processing capabilities. The control board 320 may be divided into separate processing groups for pre-processing, post-processing, and be embodied on a single board (or multiple boards with appropriate communication channels between the boards).

In FIG. 3A, a programmable device (e.g., an FPGA 330 and associated memory 340) process at least a portion of the video signal 310 to determine intensities, flare, and dim values as described above. FPGA Programming uploaded, burned, or stored into memory 340 is performed or executed in the FPGA and ultimately results in the rear modulation signal (see "To Rear Modulator" in FIG. 3A). Other parts of the same programming set may be configured to make adjustments to the front modulator signal (see "To Front Modulator" in FIG. 3A). All of the described adjustments may be made via the programming, or the tasks may be split between the FPGA (or other programmable device) and a set of electronics specifically arranged to perform the described steps or any portion of the described or equivalent steps.

FIG. 3B is a block diagram of electronic and/or computer components arranged to implement processes according to an embodiment of the present invention. FIG. 3B illustrates an architecture that includes a pre-processing board 350 that includes faster processing and/or more electronic devices hardwired for speed to perform intensive tasks for adjustment of a front modulator signal, which, as with a typical HDTV LCD screen has millions of elements for adjustment compared to a few hundred to few thousand of an exemplary low-resolution modulated backlight. In addition to compensation and provision of the front modulator signal (see "To Front Modulator" in FIG. 3B). Signal 360 is sent from the "Front Processing Board" 350 to the "Rear Processing Board" 370. "Rear Processing Board" 370 then utilizes programming loaded into processing device 380 (e.g., from memory 390, or uploaded from a network (e.g. Internet) connection—which may be flashed into memory 390 as a firmware upgrade (for example, as a firmware upgrade for existing displays, or as part of a display manufacturing step) to calculate flare and dim conditions between frames of the video signal and prepare dampened rear modulator signals according to the present invention.

Signal 360 may be configured to carry "feedback" (not shown) to the "Front Processing Board" 350 from "Rear Processing Board" 370 such that front modulation adjustments based on the final rear modulation calculation, if any, may be performed. Alternatively, such adjustments may be calculated from portions of the video signal—e.g., as they pass through to the "Rear Processing Board."

As discussed further above, the invention can also be implemented in a number of alternative ways which, for example, can be based on integration (e.g. averaging or weighted averaging) of a current frame and its previous frame(s). All implementations do not have to include scene change detection. The implementations could be used to mitigate artifacts, such as, but not exclusively limited to, low intensity difference flicker on the backlight ("temporal noise").

The approaches described above can be implemented either alone or in combination with one or more alternative approaches (e.g. dampening based on thresholds/rates in combination with integration (and weighting) across two or more frames). They can combined with other dampening methods (e.g. spatial dampening such as band limiting, energy spreading, spatial filtering or band limiting) as well.

The following is an example of implementing the invention in combination with spatial dampening approaches. The concept of a "3-D" filter has been developed by Lewis Johnson and Robin Atkins, which integrates spatial filtering and temporal filtering (in this case weighted averaging) into a single-stage filter.

The current Dolby Contrast™ algorithm proposes two stages of smoothing the backlight element (e.g. single or clusters of LEDs) drive values. The first stage limits the spatial gradient, or the difference in brightness from one cluster to the next. This is accomplished by running a spatial smoothing filter (e.g. Gaussian or similar filter) across the backlight drive signal per video frame. The second stage limits the temporal gradient, by limiting the flare (rise) and dimming (fall) rate of a backlight element from one frame to the next.

The concept is to replace the two-stage approach with a single-stage filter, which operates simultaneously on the spatial and temporal information. This could be referred to as a 3-D or tri-linear filter, or may be known as other names. The basic concept is to consider the previous backlight frame and the current frame stacked on top of each other as a three-dimensional structure as shown in FIG. 4.

Figure 4:
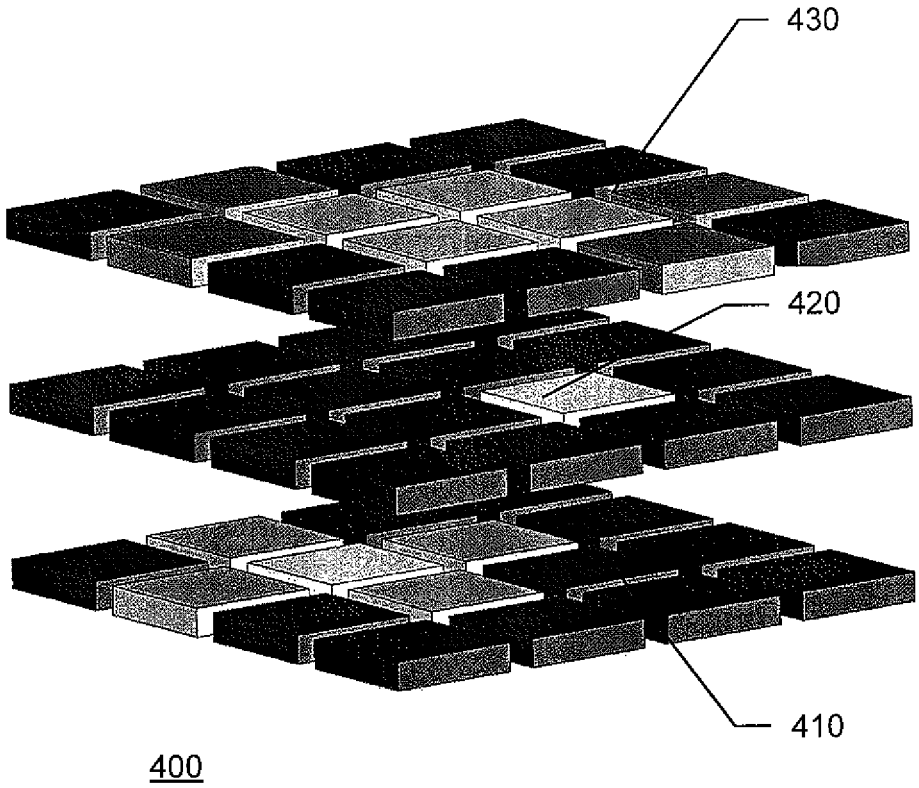
FIG. 4 is a graphic illustration of a damping process according to an embodiment of the present invention.

In FIG. 4, backlighting elements 410 illustrate backlighting intensities for 16 elements of a previous frame. Backlighting elements 420 illustrate computed desired backlight drive levels for a current frame (and, absent the artifacts issues, would represent an optimal backlighting intensity for a current frame using the illustrated backlights) (this may also be considered the result of a desired backlight modulation signal). Backlighting elements 430 represent the desired backlight modulation damped according to the present invention by consideration of the previous frame.

A single previous frame can be considered as it contains a hysteresis of all previous frames in the same scene. An alternate approach would be to use the desired backlight element drive values from previous frames, but using this method many frames (roughly 30) would have to be considered, greatly increasing computational and memory cost. The current frame is the LED drive values as reached from the most simple down-sample method possible from the input image (i.e., max). The resulting LED drive values are reached by running a filter through the current led drive levels as well as the previous drive levels simultaneously. In the example below, the filter could have dimensions 3×3×2, which is similar to the proposed spatial filter but with the third dimension. This would smooth the gradient in both spatial and temporal domains simultaneously. A result of this approach is that rapidly moving objects will not achieve their full brightness instantaneously. An object that is stationary for some time will quickly brighten to the desired level. This rate could be adjusted to match the capabilities and limitations of the human visual system to be imperceptible.

An alternate to using a filter could be to use a 2-d matrix of rise and fall rates. This might limit the spatial and temporal gradients in a similar way to the currently proposed temporal limiting filter, when applied in this way.

Alternatives of using $R_{flare}$ and $R_{dim}$ for modifying the current rear modulation signals, for example, based on add-operation (as would be performed in the flowchart of FIG. 2—adding the flare rate to the appropriate portions of the desired rear modulation signal) or multiply-operation (as in a Dolby Contrast™ Implementation).

As an example of how the invention could be implemented in combination with other techniques, any portion of the following Dolby Contrast™ implementation may be included. For example, Dolby Contrast™ provides:

To minimize temporal artifacts (e.g., minimize the "walking" LED effect), care must be taken to compute the backlight drive levels in a band-limited manner which is stable with respect to small changes in the feature position, orientation, and intensity, in a single frame as well as over time. To minimize the noticeable effects of the difference in resolution between the backlight and the LCD, the backlight element's drive values should not vary temporarily or spatially by large amounts as the input image features move.

The requirements of the backlight element value computation for Dolby Contrast are threefold:

Preserve light energy from the backlight

Maintain the center of mass of the backlight coincident with the feature

Consume minimal computational and memory resources

Figure 5:
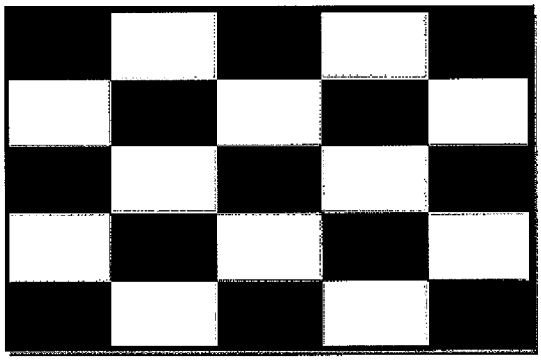
FIG. 5 is an illustration of results from backlight drive level calculations for a checkerboard pattern.
Figure 5:
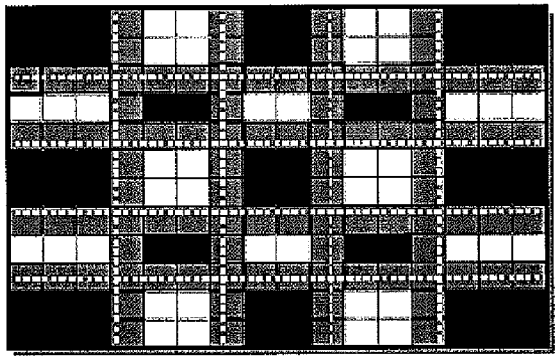

Dolby Contrast™ computes the backlight element drive values using a three-stage process to minimize the effects of backlight aliasing. For best image quality, it is also desirable to achieve a balance between high simultaneous contrast of the backlight and to preserve the luminance of bright features in the image, even if small. FIG. 5 shows results from backlight drive level calculations for a checkerboard pattern.

The following definitions apply to equations 1-6 below:

Lwork

"Working Image". This is a version of Limage which is at an intermediate resolution between the LED resolution and the original input image.

Limage

"Luminance Image". This is a grayscale (monochrome) version of the original input image.

Lout

In the case of Eq 6-5, Lout is the output image of the smoothing filter.

In the case of Eq 6-2, Lout is the output image of the luminance conversion.

Lin

In the case of Eq 6-5, Lin is the input image of the smoothing filter.

m,n

Indices to elements of image arrays.

Lt

Calculated cluster drive levels for the current frame

Lt−1

Calculated cluster drive levels for previous frames

Ln,t

Specific cluster (n) drive level in current frame.

To reduce computational requirements, the input image can be reduce in spatial resolution to a lower working resolution image $L_{work}$ using a simple and fast "max" method shown in Equation 1 below. The region taken from the original image is determined by the ratio between the resolutions of the input image and working resolution. The regions must not overlap to ensure that the total light generated by the backlight remains constant as a feature moves. If the down-sample procedure is not energy preserving, a feature will appear to pulse and dim as the backlight generates different amounts of light energy behind it. Dolby Contrast uses a minimum working resolution of two times the backlight cluster resolution.

$$L\text{work}=\max(L\text{image}[\text{region}]); \qquad \text{Equation 1}$$

Spatial aliasing is first addressed by applying a low pass spatial filter to the working image. This has the effect of smoothing the backlight gradients to spread the halo symmetrically about the object. The size of the filter can be adjusted to optimize the balance between backlight contrast and backlight aliasing for a particular implementation. An example of the filter is shown in Equation 2, using a 2-D Gaussian distribution.

$$L_{out}[m, n] = \begin{bmatrix} 1 & 2 & 1 \\ 2 & 4 & 2 \\ 1 & 2 & 1 \end{bmatrix} \frac{1}{16} L_{in}[m, n]$$

The backlight working image is down-sampled further to the resolution of the backlight clusters. As shown in Equation 3, this is done using a mean down-sample to apply additional smoothing to the backlight image. As the working image has twice the resolution of the cluster image, the region used for this process is a 3×3 region.

$$L\text{clusters}=\text{mean}(L\text{work}[\text{region}]) \qquad \text{Equation 3}$$

Dolby Contrast further addresses the "walking" LED problem by limiting the rise (flare) and fall (dim) rates of the backlight drive levels to smooth the backlight gradient over time. This is referred to as temporal filtering and is illustrated in Equations 4-6. The flare and dim limits, $R_{rise}$ and $R_{fall}$ control the maximum change in, intensity of any backlight cluster (n) between consecutive video frames. The temporal limit is ignored for sudden scene changes by comparing the difference in intensity of consecutive image processing frames with an adjustable threshold T.

$$\text{if } (L_t - L_{t-1}) < T \qquad \text{Equations 4-6}$$

$$\text{then}$$

$$L_{n,t} > L_{n,t-1} \rightarrow L_{n,t-1} = L_{n,t-1} \times R_{flare}$$

$$L_{n,t-1} > L_{n,t} \rightarrow L_{n,t-1} = L_{n,t-1} \times R_{dim}$$

The rates may be adjusted for design criteria or preferences. For example, using the rate as in the above example could result in uneven steps (e.g. a low luminance element will flare slower that a high luminance one, even if the rate is the same). Therefore, some designs may take this into account and make adjustments to the rate according to the luminance level of an element.

As noted further above, various combinations of dampening and other techniques may be utilized. Such combinations may include, for example any of the following temporal dampening implementations:

Integration between current, and previous frame(s) (based on signal on rear, on front or on both modulators), where:
- Dampening is either always active, or active when no scene change is detected
- Potentially more than two frames are used for integration
- Potentially more or less weight (or variable weighing) on each frame for integration
- Dampening (filtering) may be applied to local areas of a backlight or globally.

A More advanced implementation, where:
- Dampening is either always active, or active when no scene change is detected
- Dampening (filtering) may be applied to local areas of a backlight or globally.
- Rate or Threshold for LED's flaring ($R_{flare}$) and dimming ($R_{dim}$)
  - Rate or Threshold could be the same for $R_{flare}$ and $R_{dim}$
  - Rate or Threshold could be the different for $R_{flare}$ and $R_{dim}$
  - Rate or Threshold could be matched to the capabilities and limitations of the human visual system
  - Rate or Threshold could be adjusted dynamically depending on luminance level
  - Rate or Threshold could be adjusted dynamically depending on spatial parameters such as location and/or feature size
  - Rate or Threshold could be adjusted dynamically depending on other factors
- The rear modulation signal of the previous frame(s) could be adjusted in areas of change (e.g., only areas of change).
- The rear modulation signal of the previous frame(s) could be adjusted in areas below a threshold (e.g., only in areas below a threshold).
- The luminance map of the previous frame(s) could be adjusted (recalculated) in areas of change or significant change (e.g., only in areas of change or significant change).

And mixed implementations, where:
- Dampening based on thresholds/rates in combination with an integration across two or more frames.
- Dampening based on the above methods combined with other dampening methods, such as spatial dampening (band limiting, energy spreading).

Again, any such implementations may be included with other embodiments described herein including any aspect of the described Dolby Contrast™ implementation.

The various embodiments described herein relate generally to a frame-by-frame analysis to determine rates, but the invention may also may be specifically applied to various modes where either a full frame, or any portion of a frame (fixed or dynamic) may be used for determining the current dimming and or flare/flaring rates. In practice, it may be necessary to only accept a portion of a frame, compute all relevant output information and then move to the next portion of the frame. Memory or bandwidth limits are the usual reason for this.

Various embodiments for calculating the rates include:

1. Full frame mode: A full video frame is received by the controller, all computation is applied to the full video frame and the final result is transferred to the controllable elements before a new frame is loaded into controller.
2. Fixed partial frame mode: A fixed portion (e.g. ⅓ or ¼) of a full video frame is received by the controller, all computation is applied to this portion and the final result is transferred to the controllable elements before the next fixed portion is loaded into controller.
3. Variable partial frame mode: A variably sized portion of a full video frame is received by the controller, all computation is applied to this portion and the final result is transferred to the controllable elements before the next variably sized portion is loaded into controller. The size of the portion can adjust dynamically to compensate for different video buffer rates, memory requirements or other signal or hardware limitations.
4. Scanning mode: Data from the video frame is continuously scanned into the controller such that at any point in time a certain portion of the video frame is loaded in the controller. Incoming new pixel values replace the oldest loaded pixel values already in the controller. Computations are applied to the part or all of the loaded portion of the frame at a rate that ensures that all relevant information from older pixel values are used by the algorithm before the pixel values are unloaded from the controller during the scanning process.

Although the present invention has been mainly described herein with reference to dual modulation systems incorporating a modulated backlight and a front modulator (e.g., an LCD screen or panel), and although it is envisioned that such a dual modulation system would incorporate the main embodiments of the present invention, modulation systems with more than two modulators could, based on the present disclosure, be modified by the ordinarily skilled artisan to incorporate the same or similar dampening techniques and/or processes described herein. Further, the modulated backlights are also envisioned to be any type of modulated backlight including individual light sources (e.g., LEDs), clusters of light sources, a light source in combination with a light valve, Organic Light Emitting Diodes (OLEDs), or even other light sources such as CCFL, HCFL, etc.

In describing preferred embodiments of the present invention illustrated in the drawings, specific terminology is employed for the sake of clarity. However, the present invention is not intended to be limited to the specific terminology so selected, and it is to be understood that each specific element includes all technical equivalents which operate in a similar manner. For example, when describing an LED cluster, any other equivalent device, such as a lamp and spatial modulator, light valve, or other device having an equivalent function or capability, whether or not listed herein, may be substituted therewith. Furthermore, the inventors recognize that newly developed technologies not now known may also be substituted for the described parts and still not depart from the scope of the present invention. All other described items, including, but not limited to controllers, electronics, programming (whether software, firmware, or a collection of electronic devices configured to perform the same functions), backlights, panels, LCD's or other light valves/modulators, signals, filters, processes, etc should also be considered in light of any and all available equivalents.

Portions of the present invention may be conveniently implemented using a conventional general purpose or a specialized digital computer or microprocessor programmed according to the teachings of the present disclosure, as will be apparent to those skilled in the computer art.

Appropriate software coding can readily be prepared by skilled programmers based on the teachings of the present disclosure, as will be apparent to those skilled in the software art. The invention may also be implemented by the preparation of application specific integrated circuits or by interconnecting an appropriate network of conventional component circuits, as will be readily apparent to those skilled in the art based on the present disclosure.

The present invention includes a computer program product which is a storage medium (media) having instructions stored thereon/in which can be used to control, or cause, a computer to perform any of the processes of the present invention. The storage medium can include, but is not limited to, any type of disk including floppy disks, mini disks (MD's), optical discs, DVD, HD-DVD, Blue-ray, CD-ROMS, CD or DVD RW+/−, micro-drive, and magneto-optical disks, ROMs, RAMs, EPROMs, EEPROMs, DRAMs, VRAMS, flash memory devices (including flash cards, memory sticks), magnetic or optical cards, SIM cards, MEMS, nanosystems (including molecular memory ICs), RAID devices, remote data storage/archive/warehousing, or any type of media or device suitable for storing instructions and/or data.

Stored on any one of the computer readable medium (media), the present invention includes software for controlling both the hardware of the general purpose/specialized computer or microprocessor, and for enabling the computer or microprocessor to interact with a human user or other mechanism utilizing the results of the present invention. Such software may include, but is not limited to, device drivers, operating systems, and user applications. Ultimately, such computer readable media further includes software for performing the present invention, as described above.

Included in the programming (software) of the general/specialized computer or microprocessor are software modules for implementing the teachings of the present invention, including, but not limited to, down-sampling, averaging, comparing signals, backlight values, etc, energizing LED's, backlights, and/or backlight clusters, dampening signals, look-up or formula derivations of values, adding, multiplying signals and/or intensity values contained in signals, and the display, storage, or communication of results according to the processes of the present invention.

The present invention may suitably comprise, consist of, or consist essentially of, any of element, part, or feature of the invention and their equivalents as described herein. Further, the present invention illustratively disclosed herein may be practiced in the absence of any element, whether or not specifically disclosed herein. Obviously, numerous modifications and variations of the present invention are possible in light of the above teachings. It is therefore to be understood that within the scope of the appended claims, the invention may be practiced otherwise than as specifically described herein.

What is claimed and desired to be secured by Letter Patent of the United States is:

1. A method comprising the steps of:

receiving a segment of a video;

calculating a rear modulation signal for the received segment wherein the rear modulation signal comprises a plurality of control signals, the control signals respectively corresponding to separately-controllable elements of a backlight;

calculating a difference in intensity between the rear modulation signal of the received segment and a rear modulation signal of a previous frame corresponding to the received segment; and modifying the rear modulation signal for the received segment with a temporal filtering limit R to obtain an actual rear modulation signal for the received segment;

wherein the temporal filtering limit R limits at least a rate of increase or a rate of decrease in intensity of elements of the backlight; and wherein calculating the rear modulation signal comprises:

performing first downsampling on the received segment;

applying a spatial filter to the downsampled received segment; and performing a second downsampling on the spatially-filtered, downsampled, received segment.

2. The method according to claim 1, wherein the received segment comprises one of a full frame of the video, a fixed partial frame of the video, a variable partial frame of the video, and a scanned portion of the video.

3. The method according to claim 1, further comprising the step of determining the filtering limit R.

4. The method of claim 1 wherein the temporal filtering limit comprises a flare rate wherein modifying the rear modulation signal comprises limiting increases in intensities of the backlight elements to less than the flare rate.

5. The method of claim 4 wherein the temporal filtering limit comprises a dimming rate wherein modifying the rear modulation signal comprises limiting decreases in intensities of the backlight elements to less than the dimming rate.

6. The method of claim 5 wherein the dimming rate is variable and is a function of intensity of the backlight elements.

7. The method of claim 4 wherein the flare rate is variable and is a function of intensity of the backlight elements.

8. The method of claim 1 comprising applying the temporal filtering limit on an element-by-element basis to a plurality of backlight elements.

9. The method of claim 8 comprising calculating a forward modulation signal for driving a front modulator unit based on the actual rear modulation signal.

10. The method of claim 4 wherein applying the filtering limit comprises averaging light intensities across multiple previous frames.

11. The method of claim 1 wherein the first downsampling comprises taking maximum values within regions of an image in the received segment.

12. The method of claim 11 wherein the second downsampling comprises applying a mean-downsample.

13. A method comprising the steps of:

receiving a segment of a video;

calculating a rear modulation signal for the received segment wherein the rear modulation signal comprises a plurality of control signals, the control signals respectively corresponding to separately-controllable elements of a backlight;

calculating a difference in intensity between the rear modulation signal of the received segment and a rear modulation signal of a previous frame corresponding to the received segment; and modifying the rear modulation signal for the received segment with a temporal filtering limit R to obtain an actual rear modulation signal for the received segment;

wherein the temporal filtering limit R limits at least a rate of increase or a rate of decrease in intensity of elements of the backlight; and the method further comprising forming a three-dimensional data structure of backlight element drive values, the data structure having two spatial dimensions and a temporal dimension wherein applying the filtering limit comprises applying a three-dimensional filter to the data structure.

14. The method according to claim 1, wherein the filtering limit R is based on at least one of performance characteristics of a display on which the video is to be displayed and characteristics of the video signal.

15. The method according to claim 13, wherein: said method comprises executing by a computer a set of computer instructions stored on a computer readable media.

16. The method according to claim 15, wherein said computer instructions are compiled computer instructions stored as an executable program on said computer readable media.

17. The method of claim 13 wherein applying the temporal filtering limit comprises multiplying one or more values for a previous frame by a value corresponding to a maximum flare rate.

18. The method of claim 13 comprising applying the filtering limit on an area-by-area basis to the received segment such that some of the control signals are changed by applying the filtering limit to yield the actual rear modulation signal and others of the control signals are not changed by applying the filtering limit.

19. The method of claim 13 wherein applying the filtering limit comprises comparing a change in commanded light output for a backlight element to a threshold.

20. The method of claim 19 comprising adjusting the threshold dynamically based on a luminance level for the backlight element.

21. The method of claim 19 wherein applying the filtering limit comprises comparing a change in commanded light output for a backlight element to a flaring threshold and a dimming threshold wherein the flaring threshold is different from the dimming threshold.

22. The method of claim 13 wherein the three-dimensional filter has a kernel of dimension 3×3×2.

23. The method of claim 13 wherein the data structure comprises a matrix of backlight element drive values for a current frame stacked with a matrix of backlight element drive values for a previous frame.

24. The method of claim 13 wherein applying the filtering limits comprises applying a single-stage filter that operates simultaneously on spatial and temporal information.

* * * * *